United States Patent [19]

Chongben et al.

[11] Patent Number: 4,766,815

[45] Date of Patent: Aug. 30, 1988

[54] UP-GRADE SPEED CONTROL SYSTEM OF RAILWAY MARSHALLING YARD

[75] Inventors: Zhong Chongben; Xu Zhengli, both of Harbin, China

[73] Assignee: TDJ System Research Center of Haerbin Railway Bureau, Haerbin, China

[21] Appl. No.: 859,074

[22] Filed: May 2, 1986

[30] Foreign Application Priority Data

May 4, 1985 [CN] China ..... 85103302

[51] Int. Cl.[4] ..... B61B 1/00

[52] U.S. Cl. ..... 104/26.2; 104/26.1

[58] Field of Search ..... 104/26.1, 26 R, 26.2; 246/5

[56] References Cited

U.S. PATENT DOCUMENTS

| | | | |
|---|---|---|---|
| 2,621,035 | 12/1952 | Marden | 177/1 |
| 2,716,547 | 8/1955 | Thurston | 177/1 |
| 2,863,991 | 12/1958 | Mishelevich | 104/26.1 X |
| 3,172,490 | 3/1965 | Raskin | 104/26.1 X |

FOREIGN PATENT DOCUMENTS

| | | | |
|---|---|---|---|
| 657907 | 2/1963 | Canada | 104/26.1 |
| 2446109 | 4/1976 | Fed. Rep. of Germany | 104/26 R |
| 337117 | 3/1904 | France | 104/26.1 |

OTHER PUBLICATIONS

Martin Lang and Josef Uthoff, Modern Marshalling Yard Developments, from Railway Technical Review, 1973.

M. S. Rao, Switch Back Hump–a New Marshalling Tool, from Rail International, 4/1976.

*Primary Examiner*—Francis K. Zugel
*Assistant Examiner*—Laurie K. Cranmer
*Attorney, Agent, or Firm*—Kenyon & Kenyon

[57] ABSTRACT

This invention relates to the design of marshalling yard with up-grade speed control system. The principal difference between this yard and the conventional marshalling yard with down-grade only profile is described hereunder. Unlike the already known yard in which many speed control devices are installed on a down-grade to consume excess energy of cuts, the yard in the invention has hump height designed by taking operating conditions of moderate runners as a base and is provided with at least one up-grade speed control unit consisting of one up-grade section and a necessary number of boosters and retarders on the down-grade profile. This up-grade control unit could convert excess energy of cuts into potential energy. The invention could raise hump operating capacity of marshalling yard at a considerably reduced cost.

6 Claims, 3 Drawing Sheets

UP-GRADE SPEED CONTROL SYSTEM OF RAILWAY MARSHALLING YARD

The invention relates to up-grade speed control system of railway marshalling yard, the profile of the existing marshalling yard is usually designed to be downgrade starting from steep gradient at the hump to easy gradient at the end of yard. This kind of profile changes speed of coasting cuts of car from low to high and various speed controlling devices installed there change the speed of coasting cuts of car from high to low. This is the way which ensures the safety interval of the cuts of car in switch area and safety coupling of these cuts with cars stopping at sorting sidings. The height of hump of the existing marshalling yard is normally determined in accordance with operation conditions of bad or moderate runners. The Article "The Concept of Marshalling Technology for the Automation of the Nuremberg Gravity Marshalling Yard" published in No. 25 RTR 1983/1984 describes a profile and speed control system of a marshalling yard as follows: on a down grade starting from hump necessary level section(s), a three-step retarding (primary, main and secondary retarders) system is used for speed reducing. This idea, however has not yet been freed from the conventional marshalling yard design.

The object of this invention is to overcome the following shortcomings of conventional marshalling yard profile and speed control system:

BACKGROUND OF THE INVENTION

This invention relates to an upgrade speed control system for a railway marshalling yard.

Conventional railway marshalling yards have a single hump with a downgrade at the end of the yard. The hump height of a conventional marshalling yard is selected according to the running characteristics of poorer running cars under difficult conditions. In other words, the hump height must be high enough to ensure that the poorer running cars can run to the end of the yard and couple safely with the standing cars. In routine operations however, most of running cars or cuts have medium running characteristics, the poorer and better running cars forming but a small proportion. Consequently, the hump height designed for poorer running cars has caused the following problems. For instance, the hump height is increased for only a few poorer running cars, but the potential energy of the whole train is also increased, so the speeds of most medium and better running cars are very high at the time of entering sorting sidings, which leads to the use of additional speed control devices to reduce the cars' speed by offsetting the excess energy obtained from the hump. Moreover, in the case of braking, additional energy would also be consumed by additional speed means.

With the increase of the hump height, there should also be an increase in the elevation level of reception yard. This results in a considerable increase in the earthwork of reception yard, a much larger investment and a longer construction period as well.

An object of the present invention is to overcome the above-discussed shortcomings of the profile of the conventional railway marshalling yard.

SUMMARY OF THE INVENTION

An upgrade speed control system according to this invention is quite different from the conventional marshalling yard profile and speed control system. Pursuant to the invention, a railway marshalling yard is provided with an upgrade speed control section and a corresponding number of boosters and retarders for the profile of a downgrade marshalling yard so as to form an upgrade speed regulating unit; at least one such unit is combined with the main hump of the marshalling yard to form an up-grade speed control system.

The height between the crest of the main hump and the crest of the subhump is designed according to running characteristics of medium running cars. Some boosters are provided to replenish energy for only a few poorer running cars or cuts, while some retarders are needed to realize braking for a few better running cars or cuts. Thus, the speed of both poorer and better running cars or cuts will approximate the speed curve of moderate or average running cars or cuts.

If an upgrade speed control system of a marshalling yard with one upgrade unit is used in at least one place of humping or retarding or coupling area, the feature of each area could be:

1. When the upgrade speed control system with one upgrade speed control unit is used in the humping area, the boosters and retarders installed on the upgrade speed control unit are controlled by computer in accordance with the weight, axle number and speed of cars or cuts, thus making the upgrade speed control unit a tool to realise interspacing braking and to restore the initial time difference between poorer and better running cars or cuts at the crest. As a result, the interspacing between the cars or cuts is adjusted.

2. When an upgrade speed control system with one upgrade speed control unit is used in the retarding area, boosters and retarders installed in the upgrade speed control unit are controlled by computer in accordance with the weight, axle number and speed of cars or cuts, thus making the upgrade speed control unit a tool for applying objective braking to medium and better running cars or cuts. In this way, the medium running cars can reach the specified coupling speed without the functioning of boosters and retarders, the better running cars or cuts can also reach the specified coupling speed with the functioning of retarders; and the poorer running cars and long cuts can quickly pass through various shunting switches with the functioning of boosters.

3. When an upgrade speed control system with one upgrade speed control unit is used in the coupling area the upgrade speed control unit forms an energy reservoir which converts the power produced by booster mechanisms into potential energy of cut of cars and reserves the energy, thus extending the coasting distance of car cuts.

DETAILED DESCRIPTION

Figure 1:
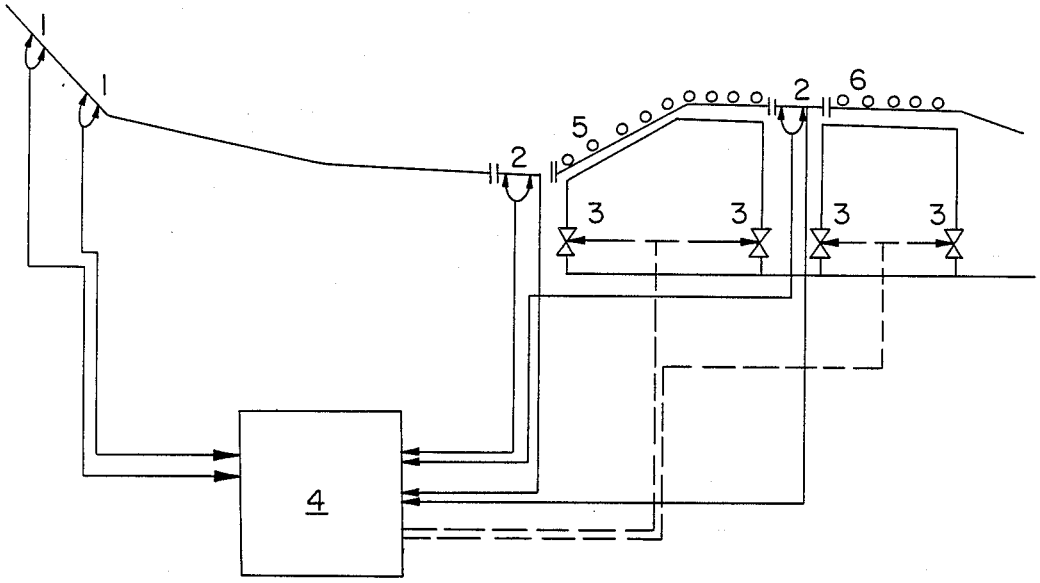
FIG. 1 is a diagram of an upgrade speed control unit according to the present invention.

As illustrated in FIG. 1, an upgrade speed control unit includes speed-measuring pedals 1, a track circuit 2, an electropneumatic valve 3, a process control computer 4, a booster 5 and a retarder 6, both the booster and retarder being components controlled by the control computer.

Figure 2:
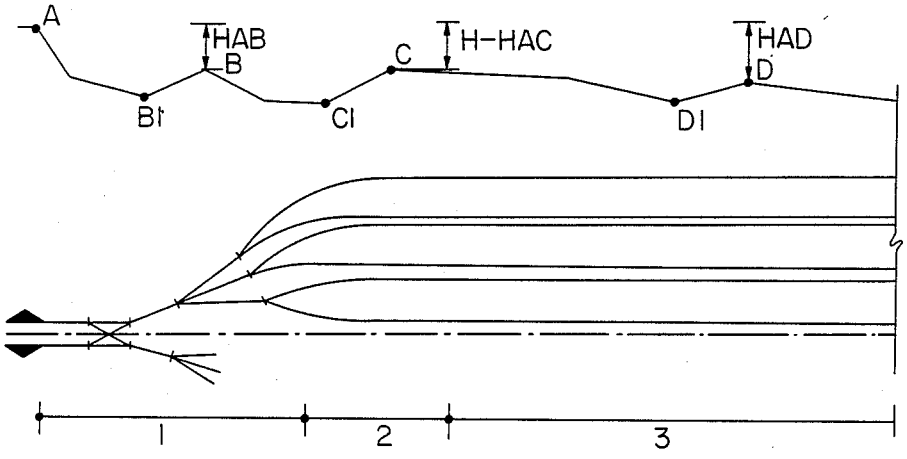
FIG. 2 is a diagram, in profile view, of an upgrade speed control system with several upgrade speed control units according to the invention.

FIG. 2 is a profile view of an upgrade speed control system with respective upgrade units provided for a switching area 1, a retarding area 2 and a coupling area 3.

The drawing shows that depressed profiles $AB_1B$, $BC_1C$ and $CD_1D$ are formed in humping area 1, retarding area 2 and coupling area 3, respectively, because of the existence of upgrades $B_1B$, $C_1C$ and $D_1D$, thus creating a wave-like profile where downgrades and upgrades are interconnected instead of a downgrade profile only. The profile is designed on the following principles:

1. The hump height (H) is designed according to the operational conditions of average or medium running cars, i.e., the height should be so designed that medium running cars can reach the specified coupling speed $V_s$ when they arrive at Point C after being humped at the velocity of $V_o$ from Point A on the crest in winter's head wind. The calculation formula for height H is:

$$H = H_{AC} = \frac{V_s^2 - V_o^2}{2q_z'} + (L_{AC}W_z^w + 6\Sigma\alpha_{AC} + 24N_{AC})10^{-3} + L_{AC}W_{FBC}^w 10^{-3}.$$

where:

$g_z'$ is the acceleration of medium running cars affected by their rotational inertia, $\Sigma\alpha_{AC}$ is the sum of degrees of turning angles of curves in Section AC, $N_{AC}$ is the number of switches in Section AC, $\omega_Z^\omega$ is the basic resistance to medium running cars in winter, $\omega_{FBC}^\omega$ is the wind resistance to medium running cars in winter (Section BC), and $$W_{FBC}^w = 0.063KF\frac{[(V_{max} + V_s)0.5 + V_F]^2}{Q_2}$$

where:

Vmax is the maximum allowable speed in humping section, $V_s$ is the allowable coupling speed of cuts, $V_f$ is the calculated wind velocity, $Q_2$ is the total weight of medium running cars.

2. The height ($H_{AB}$) of point B of up-grade section $B_1B$ should be so designed that medium running cars could still maintain the minimum allowable speed $V_{min}$ in the humping area when they arrive at Point B after being humped at a speed of $V_o$ from Point A on crest in winter's head wind.

3. The depressed profile $AB_1B$ should be so designed that the time difference between and poorer running cars in arriving at Point B is the smallest after these cars are humped at speed of $V_o$ from Point A on the crest in winter's head wind.

4. The depressed profile $BC_1C$ should be so designed that the time difference between better and poorer running cars in arriving at Point $C_1$ is the smallest after these cars roll down from Point B at their respective initial speeds of $V_N^B$ and $V_y^B$ in winter's head wind.

5. The height ($H_{AD}$) of Point D of upgrade section $D_1D$ is determined by the basic resistance to the moderate running cars. The height difference between Point D and the elevation level of the yard end should be able to ensure that medium running cars can coast from Point D to the end of yard.

In an upgrade speed control system with one upgrade unit for each area, each upgrade speed control is equipped with a certain number of boosters and retarders in accordance with its own need.

In general, an speed control system pursuant to the invention has the following advantages:

1. The upgrade speed control system is used mainly to control the speed of most medium running cars, ensuring the safe operation of a few poorer and better running cars. Consequently, the hump height is determined in accordance with the operational conditions of the medium running cars, i.e., the speed curve of the medium running cars is taken as a control reference line, to which the speed curves of poorer and better running cars should come near. As a result, the hump height could be lowered, the investment in earthwork could be reduced remarkably and speed regulation range of cars should be narrowed.

2. The upgrade speed control system is not designed using the conventional method of the profiling of a marshalling yard. According to the conventional design, the profile is provided with downgrade only and necessary level section(s) could only work as a natural accelerator for cars. The invention works to provide an upgrade section for the conventional downgrade only profile, making the section a natural retarder of cars and making other speed control devices auxilliaries only. In this way, the speed reduction of cuts would be realized mainly by the upgrade section instead of speed control devices. Therefore the investment in speed reducing equipment can be reduced.

3. The upgrade unit converts the excess energy of cuts into potential energy by use of coupling. This could extend the coasting distance of cuts, thus solving the problem of the insufficient potential energy of the hump of the existing yard and realizing rational use of the excess energy of cuts.

4. The braking performance produced by the upgrade section is of gravity type, which has the same braking effect on both loaded and unloaded cars. Unlike retarders which suddenly change the running speed of cars, the upgrade section could reduce the running speed of cuts gradually in a relatively long distance, thus extending the service life of railway cars.

The above mentioned advantages have been proved by the actual application of the upgrade speed control system. According to the initial estimate, to realize the marshalling automation, a marshalling yard with the upgrade speed control system of the invention can save 30% of equipment cost as compared with a marshalling yard employing another speed control system. Modifying an existing marshalling yard by adopting an upgrade speed control system according to the present invention could realize marshalling automation, increasing hump operating capacity and the safe coupling rate with the minimum investment and at the shortest construction period. The application of upgrade speed control system of the invention in a new marshalling yard could lower the hump height the level of the reception yard, and reduce the number of speed control devices, increase the hump operating capacity and safety coupling rate with the cast considerably reduced.

Figure 3:
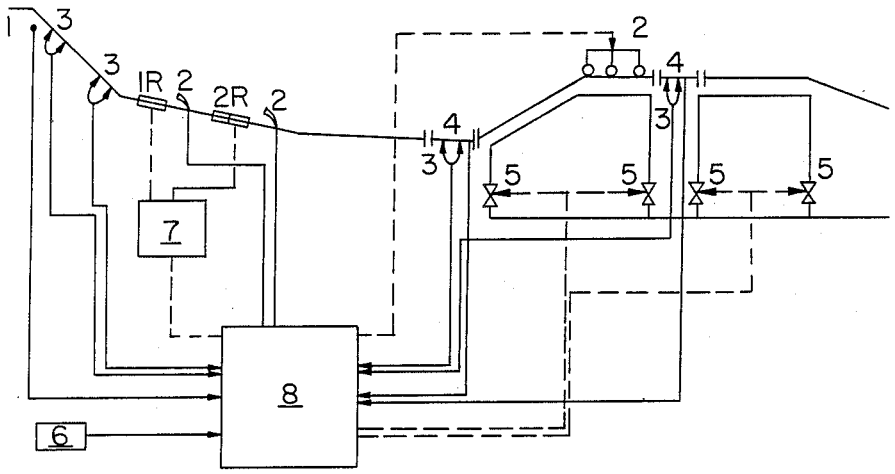
FIG. 3 is a diagram of a marshalling yard with a retarding area provided with an upgrade speed control unit.

FIG. 3 shows an example of a marshalling yard with an upgrade unit pursuant to the invention in the retarding area, including a weight measuring device 1 for measuring weight and counting axle of cuts, radar antennas 2, a speed measuring pedal 3, a track circuit 4 for transmission of reliable information relating to cuts before their arrival at the upgrade section, an electropneumatic valve 5 for controlling the air supply of the sealed, circular air pipe line, a switch operating indicator 6, a retarder console 7 for interval braking, used for changing to manual operation in the case of equipment trouble, and a process control computer 8 which controls not only the upgrade speed control unit in the retarding area, but also the retarder for interspace braking. This is an example of modifying an existing marshalling yard by employing an upgrade unit according to the present invention in the retarding area of the yard and by combining the unit with the existing speed control devices in the yard. The operating procedures in such a modified marshalling yard are described hereunder. When the cuts roll down from the crest, the weight measuring device will first measure their weights and count axles. Then the average weight of cuts is determined and sent into the computer as a control parameter. When the cuts reach the retarder for interval braking, the retarder realizes interspace braking of cuts in accordance with the computer's instruction. When radar detects that the cuts have the specified outlet speed of cuts, the retarder releases the cuts. Before the cuts reach the upgrade speed control unit, the computer will send instructions to the electropneumatic valve according to the obtained information about weight, axle number and speed of cuts. Normally there are three cases:

1. If the entering cuts are better running, the boosters are not activated. Only the retarder reduces the speed of cuts to the specified coupling speed and then releases the cuts to roll out from the upgrade speed control unit;

2. If the entering cuts are medium running, the boosters are activated. The retarder does not function basically. The cuts will roll out from the upgrade speed control unit by keeping the specified coupling speed; and 3. If the entering cuts are poorer running, the boosters are activated and the retarder does not function basically. The cuts would be given the specified coupling speed and roll out from the upgrade speed control unit.

We claim:

1. In a railway marshalling yard, a speed control system comprising:

primary acceleration means for providing a predeterminable initial speed to a running car to be sorted, said primary acceleration means including a main hump over which a railway track guiding said running car extends;

first deceleration means for decreasing a velocity of said running car upon acceleration of said running car to said initial speed, said first deceleration means including at least one subhump over which said railway track extends downgrade of said main hump, said subhump having a height differing from a height of said main hump in accordance with the running characteristics of an average railway car;

control means for determining acceleration and deceleration characteristics of said running car, said control means including velocity and weight sensors disposed alongside said railway track at said subhump;

second deceleration means including a retarding mechanism operatively coupled to said control means for additionally decreasing, under the control of said control means, the velocity of said running car upon a determination by said control means that said running car has better running characteristics, said second deceleration means being disposed downgrade of said subhump; and secondary acceleration means including a booster mechanism operatively coupled to said control means for accelerating, under the control of said control means, said running car upon a determination by said control means that said running car has poorer running characteristics, said secondary acceleration means being disposed downgrade of said main hump.

2. The speed control system defined in claim 1, further comprising at least one third deceleration means for decelerating said running car subsequently to decreases of velocity thereof by said first deceleration means, said third deceleration means including at least one additional subhump over which said railway track extends downgrade of said subhump, whereby said railway track follows a wave-like path downgrade of said main hump.

3. The speed control system defined in claim 2 wherein said control means further includes detector means for determining weight, speed and axle number of said running car, said control means also including a computer operatively connected to said detector means, said retarding mechanism and said booster mechanism for selectively activating said retarding mechanism and said booster mechanism in accordance with the weight, speed and axle number of said running car.

4. The speed control system defined in claim 3 wherein said railway track has a coupling area downgrade of said additional subhump, further comprising an additional retarding mechanism disposed in said coupling area for decreasing running car velocity by increasing running car potential energy.

5. The speed control system defined in claim 1 wherein said control means further includes detector means for determining weight, speed and axle number of said running car, said control means also including a computer operatively connected to said detector means, said retarding mechanism and said booster mechanism for selectively activating said retarding mechanism and said booster mechanism in accordance with the weight, speed and axle number of said running car.

6. The speed control system defined in claim 1 wherein said railway track has a coupling area downgrade of said subhump, further comprising an additional booster mechanism and an additional retarding mechanism disposed in said coupling area for maintaining a coupling velocity of running cars by increasing running car potential energy.

* * * * *

UNITED STATES PATENT AND TRADEMARK OFFICE

CERTIFICATE OF CORRECTION

PATENT NO. : 4,766,815

DATED : August 30, 1988

INVENTOR(S) : Z. Chongben et al.

It is certified that error appears in the above-identified patent and that said Letters Patent is hereby corrected as shown below:

Column 1, line 23, replace "hump necessary" by --hump with necessary--.

Column 2, line 50, replace "cut of cars" by --cuts of car--.

Column 3, line 24, replace "$2q_z$" by --$2g_z$'--.

Column 3, line 35, replace "$\omega_Z{}^{\omega}$" by --$\omega_z^{\omega}$--.

Column 3, line 37, replace "$\omega_{FBC}{}^{\omega}$" by --$\omega_{FBC}^{\omega}$--.

Column 3, line 46, replace "$V_f$" by --$V_F$"--.

Column 3, line 56, replace "between and" by --between better and--.

UNITED STATES PATENT AND TRADEMARK OFFICE

CERTIFICATE OF CORRECTION

PATENT NO. : 4,766,815

DATED : August 30, 1988

INVENTOR(S) : Z. Chongben et al.

It is certified that error appears in the above-identified patent and that said Letters Patent is hereby corrected as shown below:

Column 4, line 4, replace "control is" by --control unit is--.

Column 4, line 7, replace "an speed" by --an upgrade speed--.

Column 4, line 20, replace "should" by --could--.

Column 4, line 60, replace "of upgrade" by --of the upgrade--.

Column 4, line 62, replace "height the" by --height and the--.

Column 4, line 63, replace "and reduce" by --reduce--.

UNITED STATES PATENT AND TRADEMARK OFFICE

CERTIFICATE OF CORRECTION

PATENT NO. : 4,766,815

DATED : August 30, 1988

INVENTOR(S) : Z. Chongben et al.

It is certified that error appears in the above-identified patent and that said Letters Patent is hereby corrected as shown below:

Column 4, lines 63-64, replace "devices, increase" by --devices, and increase"--.

Column 4, line 65, replace "cast" by --cost--.

Column 5, line 1, replace "axle of cuts" by --axles of cuts--.

Signed and Sealed this

Thirty-first Day of January, 1989

*Attest:*

*Attesting Officer*

DONALD J. QUIGG

*Commissioner of Patents and Trademarks*